US006349940B1

(12) United States Patent
Nimry

(10) Patent No.: US 6,349,940 B1
(45) Date of Patent: Feb. 26, 2002

(54) COLLAPSIBLE, GAME CARD HOLDING MEANS

(76) Inventor: Betty Florene Nimry, 5102 76th St., Lubbock, TX (US) 79424

( * ) Notice: Subject to any disclaimer, the term of this patent is extended or adjusted under 35 U.S.C. 154(b) by 0 days.

(21) Appl. No.: 09/237,208

(22) Filed: Jan. 25, 1999

(51) Int. Cl.[7] ..... A63F 1/10
(52) U.S. Cl. ..... 273/150; 273/148 A
(58) Field of Search ..... 273/148 A, 150

(56) References Cited

U.S. PATENT DOCUMENTS

| | | | | | |
|---|---|---|---|---|---|
| 986,665 | A | * | 3/1911 | Wilder | 273/150 |
| 1,109,524 | A | | 9/1914 | Gessner | |
| 1,828,735 | A | * | 10/1931 | Givone et al. | 273/150 |
| 1,996,234 | A | * | 4/1935 | Deinstein | 273/150 |
| D127,354 | S | | 5/1941 | Paradise | |
| D178,295 | S | | 7/1956 | Lee | D34/13 |
| D246,062 | S | | 10/1977 | Kowalski | D34/13 A |
| D264,358 | S | | 5/1982 | Welteroth | D21/54 |
| D280,112 | S | | 8/1985 | Calabro | D21/54 |
| D286,897 | S | | 11/1986 | Herert | D21/54 |
| 4,625,966 | A | | 12/1986 | Sweet | 273/150 |
| 4,684,132 | A | | 8/1987 | Wolford | 273/150 |
| D297,030 | S | | 8/1988 | Sweet | D21/54 |
| D297,150 | S | | 8/1988 | Sweet | D21/54 |
| 5,445,378 | A | | 8/1995 | Cook | 273/150 |
| 5,472,198 | A | | 12/1995 | Alvarez | 273/150 |
| D367,082 | S | | 2/1996 | Harley | D21/54 |
| D367,501 | S | | 2/1996 | Molt | D21/54 |
| D372,742 | S | | 8/1996 | Kakudo | D21/54 |
| 5,590,880 | A | | 1/1997 | Flam | 273/150 |

FOREIGN PATENT DOCUMENTS

| | | | | |
|---|---|---|---|---|
| CA | 522535 | * | 3/1956 | 273/150 |
| DE | 836020 | * | 7/1952 | 273/150 |
| GB | 107597 | * | 7/1918 | 273/150 |

* cited by examiner

*Primary Examiner*—Benjamin H. Layno
(74) *Attorney, Agent, or Firm*—John D. Gugliotta

(57) ABSTRACT

A collapsible, game card holding means is provided having a handle that allows the user to organize and hold a hand of playing cards and greatly reduces the amount of effort required to maintain the hand. Pivotally attached to the top of the handle portion are a plurality of flexible fingers. The flexible fingers can be laterally separated and retracted in a fan-like configuration, even while the playing cards are positioned and held in place at the end of the flexible fingers by a playing card securement means. A stand extends from the base of the present invention to permit the present invention to remain in the vertical position without being held. In an alternate embodiment, fan facie covers the front of the present invention, providing a visible barrier to viewing of the playing cards in the card securement means.

16 Claims, 9 Drawing Sheets

COLLAPSIBLE, GAME CARD HOLDING MEANS

RELATED APPLICATIONS

The present invention was first described in a Disclosure Document filed on Feb. 4, 1998. There were no previously filed, nor copending applications anywhere in the world.

BACKGROUND OF THE INVENTION

1. Field of the Invention

The present invention relates generally to playing card holding devices and, more particularly, to a collapsible, game card holding means.

2. Description of the Related Art

Card games are among the most popular of today's recreational and social activities. Millions of people enjoy the thousands of existing card game variations. These games are especially popular among the elderly as they use the games as a means to gather with friends and socialize.

Unfortunately, many of these people suffer from symptoms of aging and various diseases that affect their motor skills, thereby inhibiting their ability to play cards due to the need to handle and organize the cards in their hands. Furthermore, people who are not affected by the aforementioned afflictions are often inconvenienced in handling the volume of cards in their hands. In either situation, the burdens associated with card playing detract from the recreational and social benefits associated therewith. Accordingly, the need has developed for a solution to these problems that allow one to handle a hand of cards easily and in an organized manner. Ideally, the cards can be handled using only one hand, freeing the other hand for use during game play.

Several patents disclose designs for handled playing card holders that are used to display the cards in a fan-like manner. These include U.S. Pat. No. 5,472,198, issued in the name of Alvarez, U.S. Pat. No. 5,445,378, issued in the name of Cook, U.S. Pat. No. 1,109,524, issued in the name of Gessner, U.S. Pat. No. Des. 280,112, issued in the name of Calabro, U.S. Pat. No. Des. 178,295, issued in the name of Lee, and U.S. Pat. No. Des. 127,354, issued in the name of Paradise.

However, none of these are collapsible, nor do they use a finger-like card supporting method similar to that disclosed in the present invention. Several patents disclose designs for playing card holders that rest upon the playing surface while displaying the cards. These include U.S. Pat. No. 5,590,880, issued in the name of Flam, U.S. Pat. No. 4,684,132, issued in the name of Wolford, U.S. Pat. No. 4,625,966, issued in the name of Sweet, U.S. Pat. No. Des. 372,742, issued in the name of Kakudo, U.S. Pat. No. Des. 367,501, issued in the name of Molt, U.S. Pat. No. Des. 367,082, issued in the name of Harley, U.S. Pat. No. Des. 297,150, issued in the name of Sweet, U.S. Pat. No. Des. 297,030, issued in the name of Sweet, U.S. Pat. No. Des. 286,897, issued in the name of Herbert, U.S. Pat. No. Des. 264,358, issued in the name of Welteroth, and U.S. Pat. No. Des. 246,062, issued in the name of Kowalski.

A search of the prior art did not disclose any patents that read directly on the claims of the instant invention. Consequently, a need has been felt for providing an apparatus and method which overcomes the problems cited above.

SUMMARY OF THE INVENTION

It is therefore an object of the present invention to provide an improved collapsible, game card holding means that permits the user to easily and conveniently hold a plurality of cards using only one hand.

Briefly described according to one embodiment of the present invention, a collapsible, game card holding means is disclosed, comprising a handled device that allows the user to organize and hold a hand of playing cards and greatly reduces the amount of effort required to maintain the hand.

The present invention consists of a handle portion, of a generally linearly elongated configuration. Attached to the top of the handle portion are a plurality of flexible fingers, of a generally linearly elongated configuration. The flexible fingers protrude outward radially from the top of the handle portion. The flexible fingers can be laterally separated and retracted in a fan-like configuration.

A limiting means is connected to the top of the handle portion, and is positioned on both sides of the flexible fingers, with each flexible finger passing therethrough. The limiting means comes into mechanical interference with each flexible finger, thus creating frictional resistance that holds the flexible fingers in a desired position.

Card securement means are located at the end of each flexible finger, opposite the handle portion. The card securement means is configured to hold a playing card. In the preferred embodiment, the card securement means consists of a card slot, extending into the flexible finger from the top end of the flexible finger a sufficient distance, so as to hold the card in place via frictional resistance, with the playing cards facing the user.

The end portions of the flexible fingers, opposite the handle portion, are curved in the same plane as the plane formed by the extended flexible fingers. This curvature reduces the rotational ability of the cards once positioned in the card securement means.

A standing member is located inside the handle portion, and may be extended to support the present invention in the vertical position.

The flexible fingers may be retracted with the cards in the end portions, so as to enable the user to transport the playing cards in an easy manner.

It is envisioned that the present invention come in a variety of colors, and the handle be configured in several ergonomic designs that provide a comfortable fit in the user's hand.

In an alternate embodiment, the flexible fingers are of a flat, laterally extending figuration, with various configurations such as oval or rectangular. The flexible fingers expand and retract in a fan-like configuration. The frictional resistance between the main surface areas of the various flexible fingers facilitates insertion of and securement of playing cards therein, and as such acts as the card securement means.

In another alternate embodiment, the playing cards are inserted vertically into the card securement means, and a fan facie provides a visible barrier to the viewing of playing cards positioned in the card securement means, between each flexible fingers and its corresponding rectangular, outward flaring bar.

It is another object of the present invention to provide a device radially in a fan-like manner and provide a means by which to hold and support a number of playing cards.

It is envisioned that the present invention is comprised of material selected from the group comprising plastic and metal.

It is another object of the present invention to provide a device that holds playing cards in an adjustable, easy to read fashion. This benefit helps those with limited hand coordination or strength, such as the old, young or infirm.

It is another object of the present invention to provide a device that frees up hands during game play.

It is another object of the present invention to provide a device that is easy to store and transport.

It is another object of the present invention to provide a device that facilitates easy rearrangement of card order during game play.

| DESCRIPTIVE KEY | |
|---|---|
| 10 | collapsible, game card holding means |
| 15 | playing card |
| 20 | handle portion |
| 30 | pivoting means |
| 40 | flexible finger |
| 50 | limiting means |
| 60 | card securement |
| 70 | standing member |
| 75 | bar |
| 80 | hinge mechanism |
| 90 | fan facie |
| 100 | decorative markings |

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

In order to describe the complete relationship of the invention, it is essential that some description be given to the manner and practice of functional utility and description of a collapsible, game card holding means 10.

The best mode for carrying out the invention is presented in terms of its preferred embodiment, herein depicted within the FIGS. 1 through 8.

1. Detailed Description of the Figures

Figure 1:
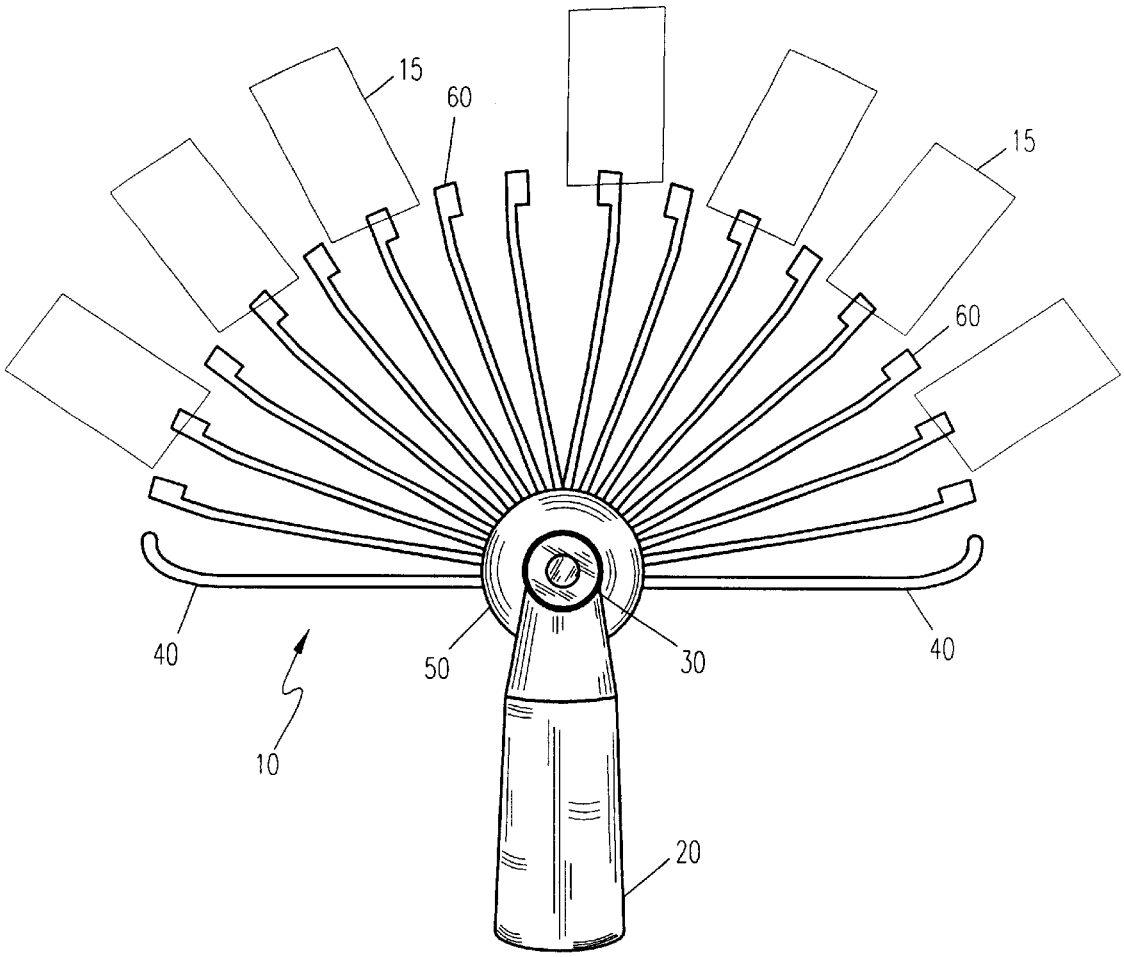
FIG. 1 is a front perspective view of the preferred embodiment of a collapsible, game card holding means 10.

Referring now to FIG. 1, a collapsible, game card holding means 10 is shown, according to the present invention, comprises a handled device that allows the user to organize and hold a hand of playing cards 15 and greatly reduces the amount of effort required to maintain the hand.

Figure 2:
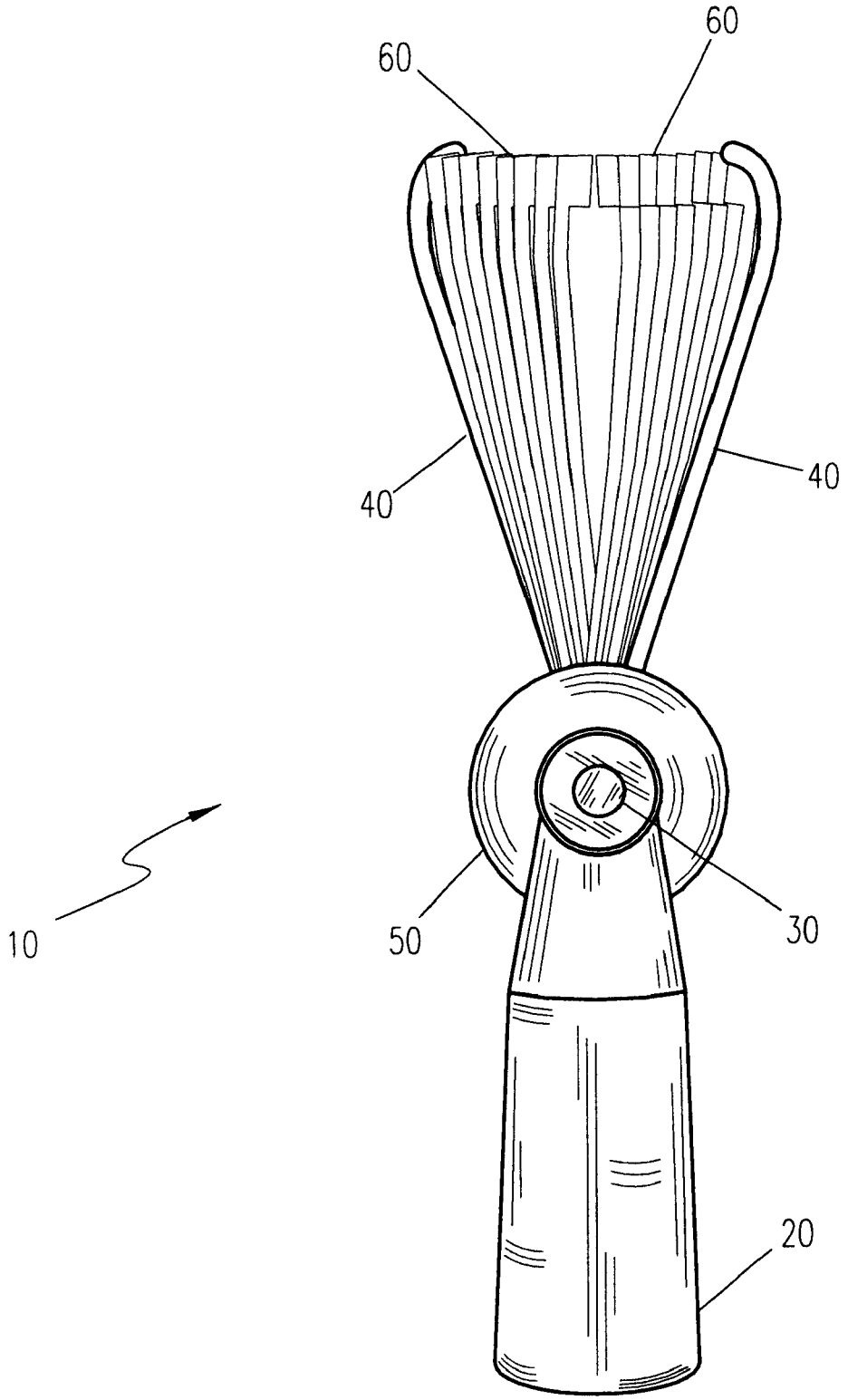
FIG. 2 is a front view thereof, in the retracted position.

Referring now to FIGS. 1 & 2, the present invention consists of a handle portion 20, of a generally linearly elongated configuration. Pivotally attached to the top of the handle portion 20, via a pivoting means 30, are a plurality of flexible fingers 40, of a generally linearly elongated configuration. The flexible fingers 40 protrude outward radially from the top of the handle portion 20.

Referring now to FIG. 2, the flexible fingers 40 can be laterally separated and retracted in a fan-like configuration.

Figure 3:
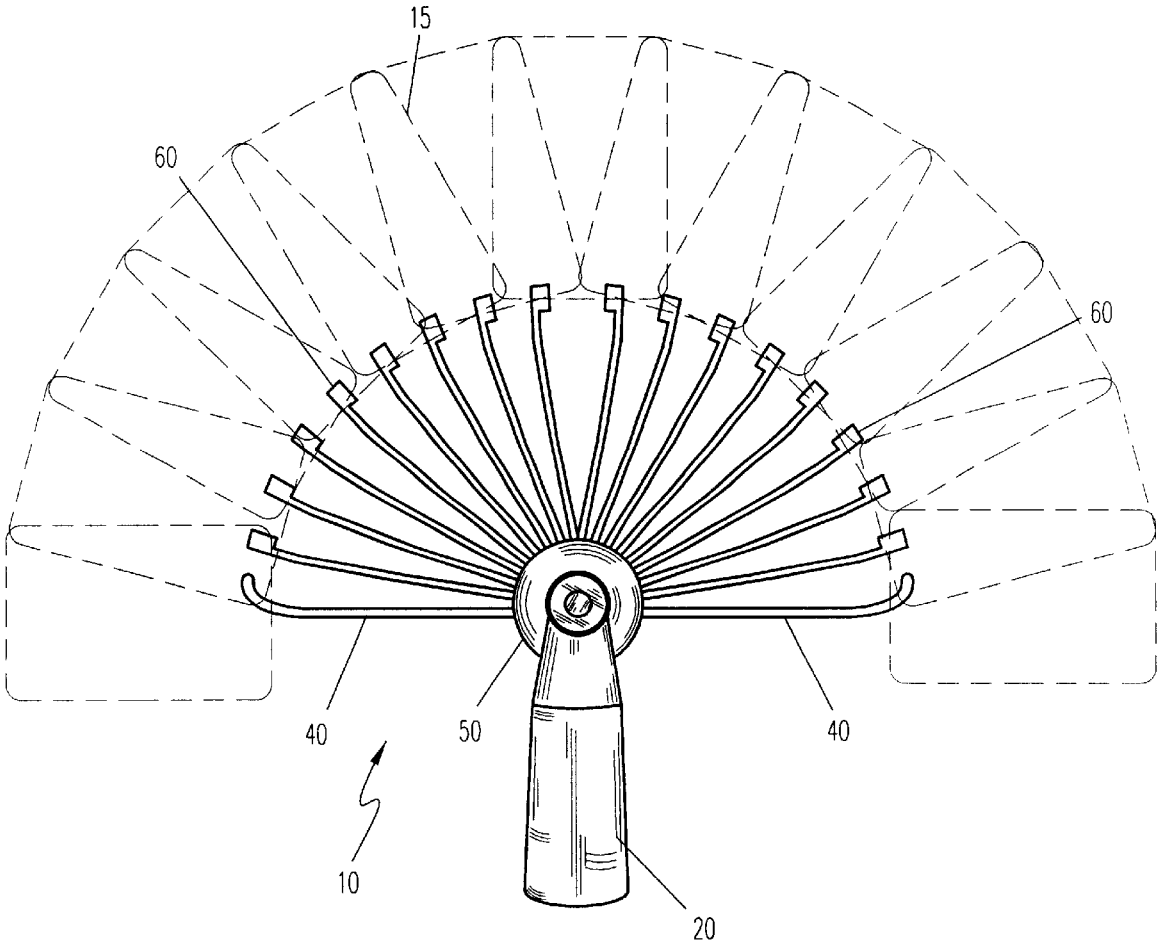
FIG. 3 is a front perspective of the preferred embodiment in use with playing cards.

Referring now to FIGS. 1, 2 & 3, a limiting means 50 is connected to the top of the handle portion 20, and is positioned on both sides of the flexible fingers 40, with each flexible finger 40 passing therethrough.

Figure 4:
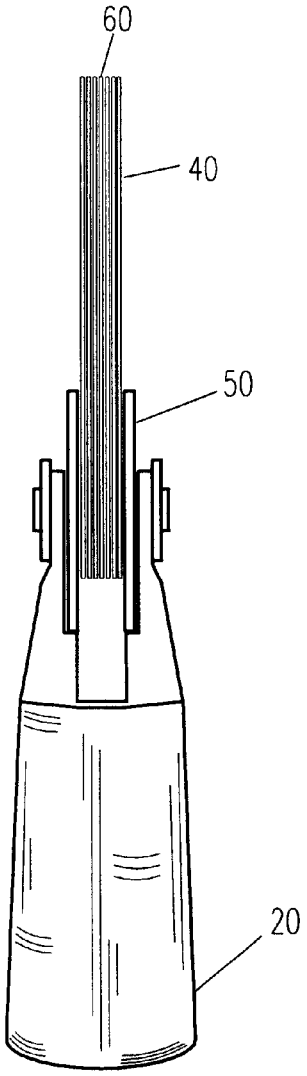
FIG. 4 is a right side view of the preferred embodiment, the left side view being a mirror image thereof.

Referring now to FIGS. 3 & 4, the limiting means 50 comes into mechanical interference with each flexible finger 40, thus creating frictional resistance that holds the flexible fingers 40 in a desired position.

Referring now to FIGS. 1 & 3, card securement means 60 are located at the end of each flexible finger 40, opposite the handle portion 20. The card securement means 60 is configured to hold a playing card 15.

Figure 5:
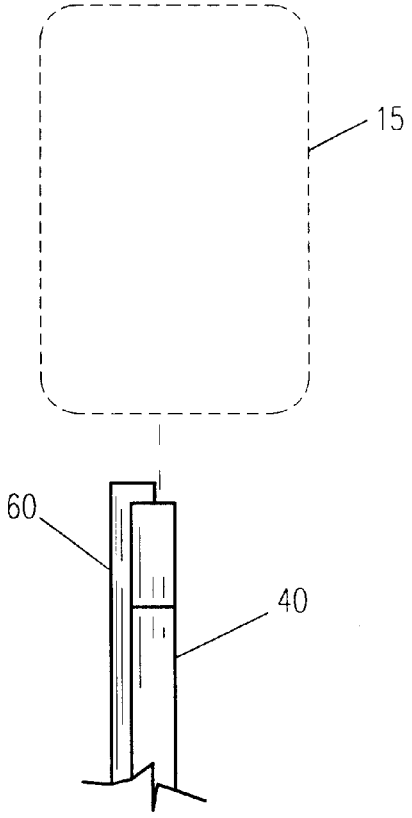
FIG. 5 is an exploded view of the card securement means in use.

Referring now to FIGS. 1, 3 & 5, in the preferred embodiment, the card securement means 60 consists of a card slot, extending into the flexible finger 40 from the top end of the flexible finger 40 a sufficient distance, so as to hold the playing card 15 in place via frictional resistance, with the playing cards 15 facing the user.

Referring now to FIGS. 1 & 4, the end portions of the flexible fingers 40, opposite the handle portion 20, are curved in the same plane as the plane formed by the extended flexible fingers 40. This curvature reduces the rotational ability of the cards 15 (not shown in FIG. 4) once positioned in the card securement means 60.

Figure 6:
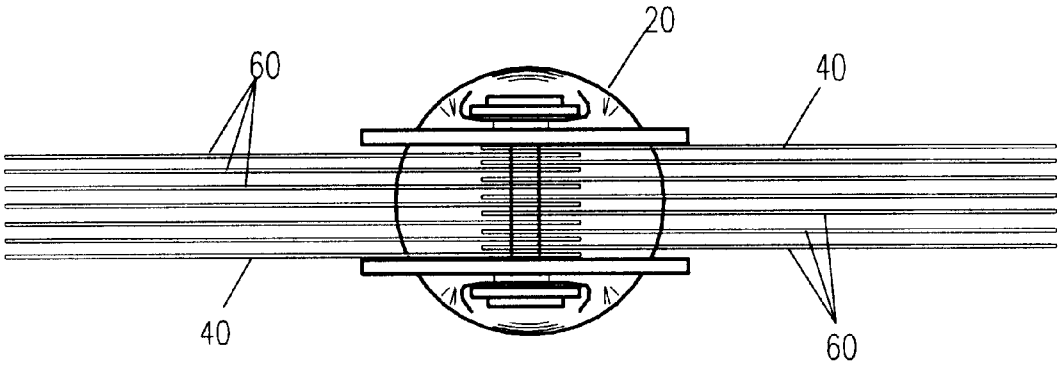
FIG. 6 is a top view of the preferred embodiment.
Figure 7:
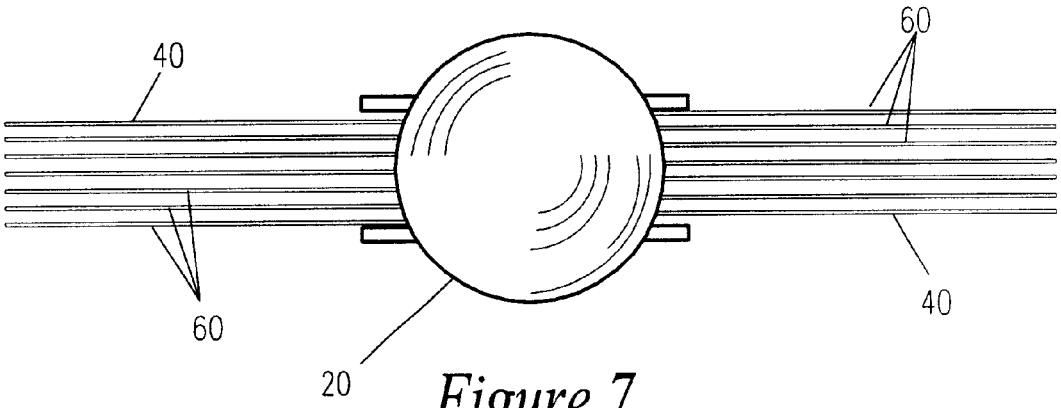
FIG. 7 is a bottom view thereof.

Referring now to FIGS. 6 & 7, the fan type configuration of the present invention can be seen clearly. It is envisioned that the flexible fingers 40 may be retracted with the playing cards 15 in the card securement means 60, so as to enable the user to transport the playing cards 15 in an easy manner.

Figure 8:
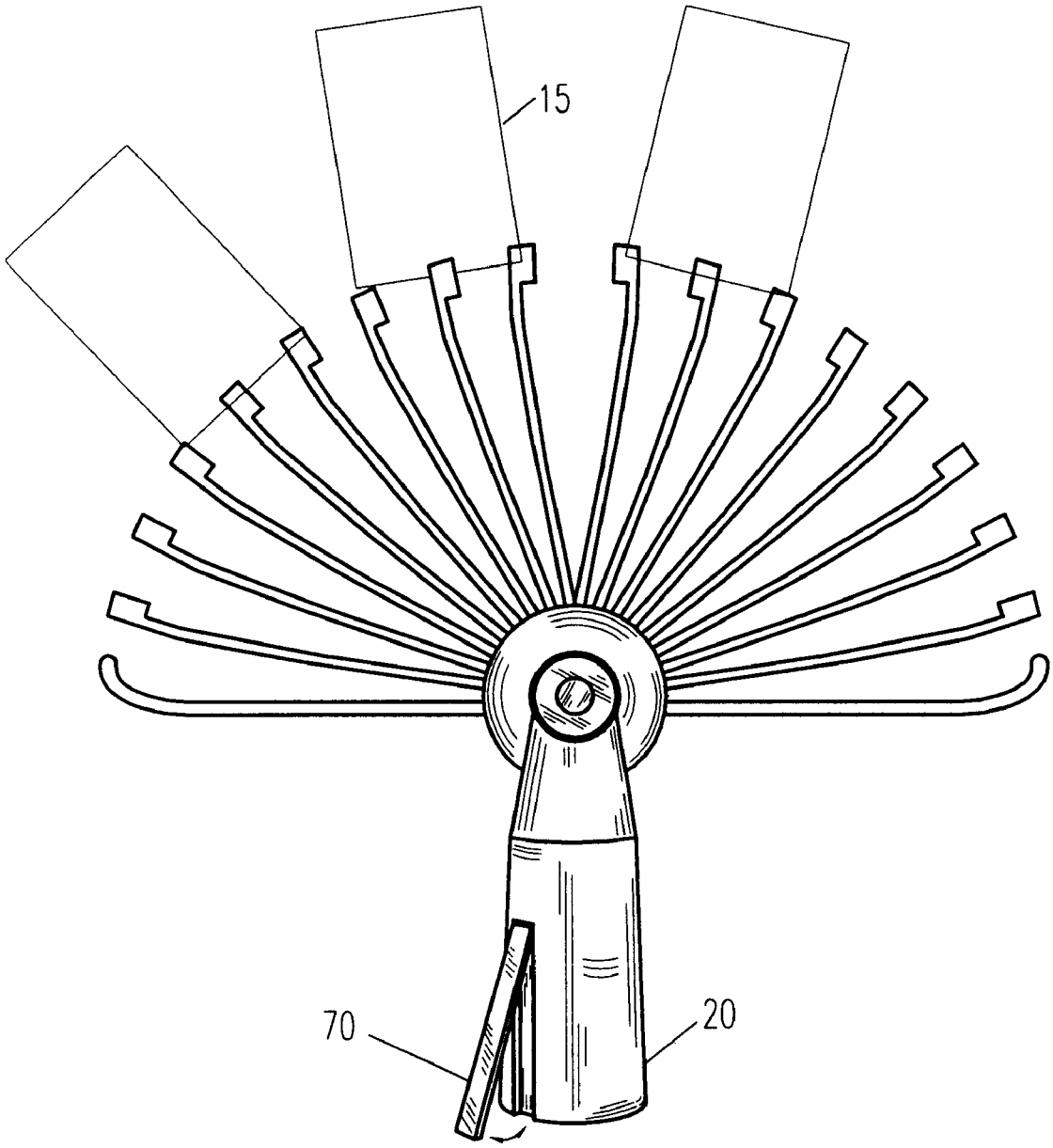
FIG. 8 is a perspective view of the present invention being held in the vertical position by the stand member.

Referring now to FIG. 8, a standing member 70 is located inside the handle portion 20 and may be extended to support the present invention in the vertical position. For purposes of disclosure, the standing member 70 is connected to the handle portion 20 via a hinge.

It is envisioned that the present invention come in a variety of colors, and the handle portion 20 be configured in several ergonomic designs that provide a comfortable fit in the users hand.

Figure 9:
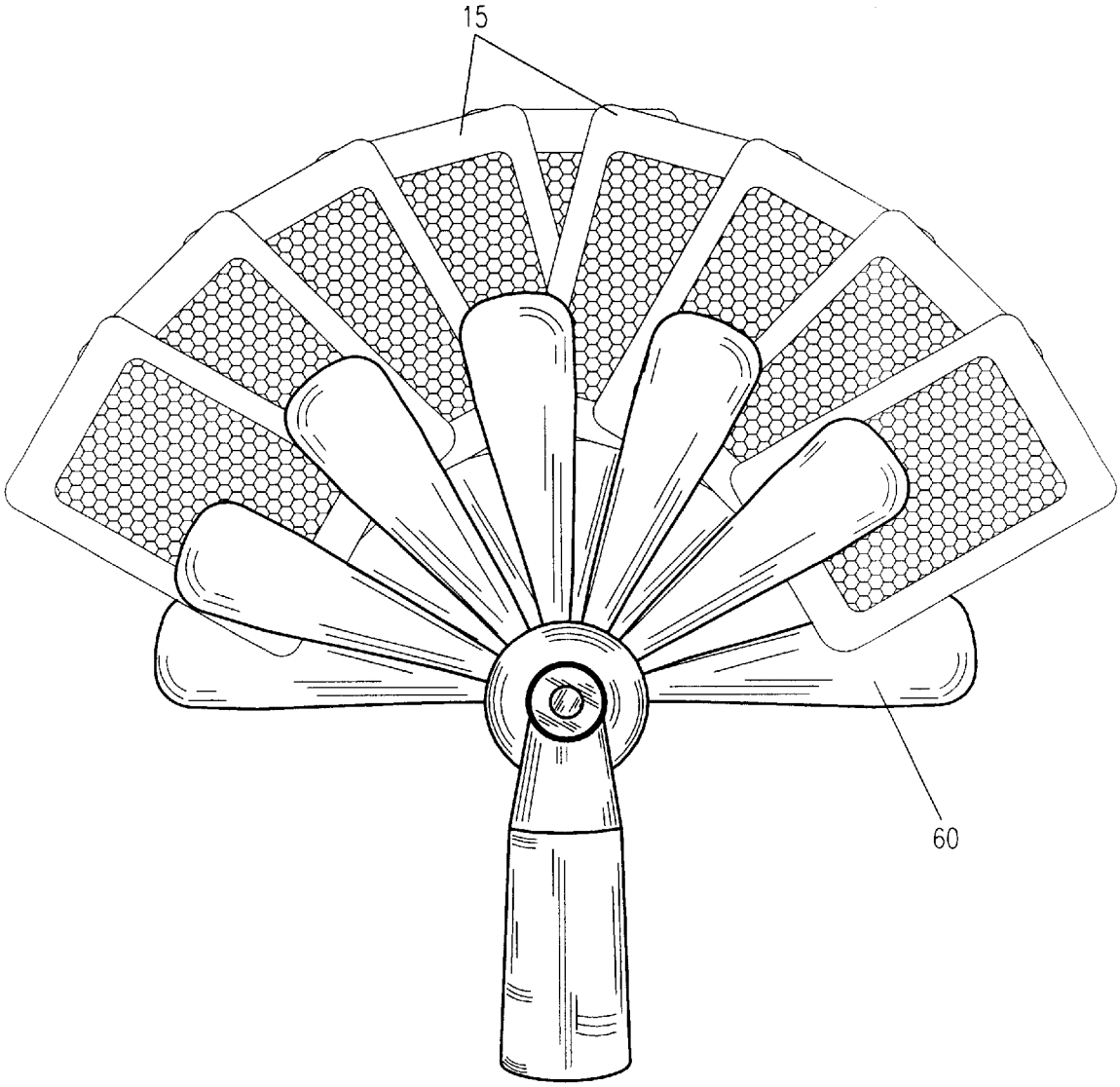
FIG. 9 is a front perspective view of an alternate embodiment of the present invention, in use.

Referring now to FIG. 9, in an alternate embodiment, the flexible fingers 40 are of a flat, laterally extending configuration, with various configurations such as oval or rectangular. The flexible fingers 40 expand and retract in a fan-like configuration.

Figure 10:
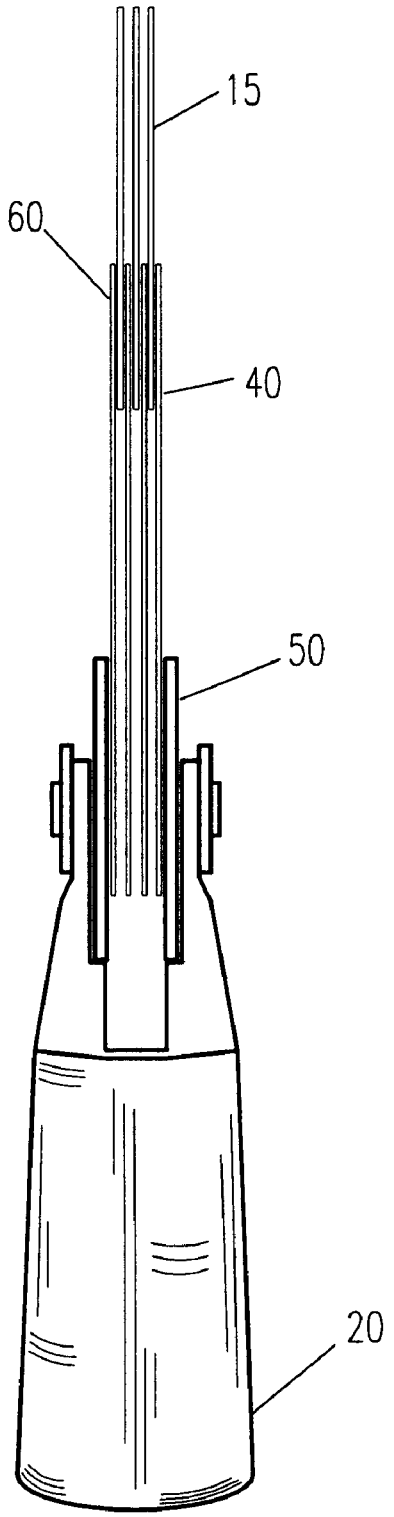
FIG. 10 is a right side, in use view thereof.

Referring now to FIG. 10, the friction resistance between the main surface areas of the various flexible fingers 40 facilitates insertion of and securement of playing cards 15 therein, and as such acts as the card securement means 60.

Figure 11:
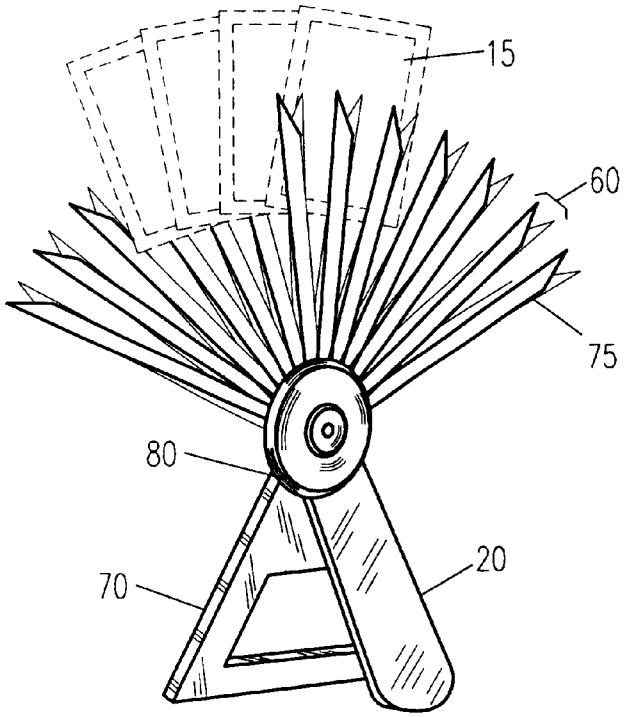
FIG. 11 is a rear view of another alternate embodiment of the present invention, showing a modified card securement means.

Referring now to FIG. 11, another alternate embodiment of the present invention is disclosed. The card securement means 60 is depicted as a linearly elongated, rectangular bar 75 attached to the end of each flexible finger 40, along the same elongated centerline as the flexible fingers 40, on the rear side of each flexible finger 40. The bar 75 flares outward relative to each flexible finger 40, as the bar 75 approaches the end of the flexible finger 40, opposite the handle portion 20, so as to form a friction fit between each flexible finger 40 and each bar 75, as a playing card 15 is slidably inserted along the elongated centerline of each flexible finger 40, between each flexible finger 40 and corresponding bar 75. Thus, in this embodiment, each playing card 15 is inserted vertically into each card securement means 60.

The standing member 70 is depicted as being of a generally triangular configuration, attached to the handle portion 20 via a hinge mechanism 80. As such, the standing member 70 does not retract into the handle portion 20, but rather rests flush against the exterior surface of the handle portion 20.

Figure 12:
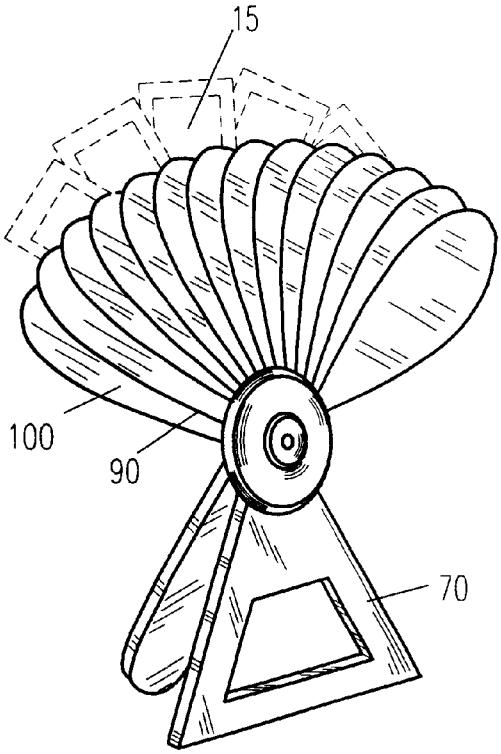
FIG. 12 is a front view thereof, showing a fan facie.

Referring now to FIG. 12, a one-piece, fan facie 90 is attached to the front of each flexible finger 40 so as to create a hand-held, fan-like appearance and configuration, as the flexible fingers 40 are extended and retracted from each other during use of the present invention. The fan facie 90 is designed to provide a decorative barrier to viewing of each playing card 15, especially when players are sitting on either side of the user of the present invention. It is envisioned that decorative markings 100 can be placed on the front surface of the fan facie 90.

It is envisioned that other styles and configurations of the flexible fingers 40, handle portion 20, limiting means 50, card securement means 60, and the standing member 70 can be easily incorporated into the teachings of the present invention, and only one particular configuration shall be shown and described for purposes of clarity and disclosure and not by way of limitation of scope.

2. Operation of the Preferred Embodiment

To use the preferred embodiment of the present invention: first, the user extends the flexible fingers 40 laterally; second, the user places playing cards 15 in the card securement means 60 so as to facilitate play of a particular game; third, during game play, the user can switch playing cards 15 around in the card securement means 60 and organize them as playing cards 15 are dealt, drawn, played and discarded; use of the present invention allowing the user to free-up his hands to do other things while playing; fourth, when game play is completed, the flexible fingers 40 are retracted and the present invention is stored away for later use. The standing member 70 may be used to support the present invention in the vertical position. If the user wishes, he or she may retract the flexible fingers 40 with the playing cards 15 still in the card securement means 60.

In the first alternate embodiment of the present invention, as shown in FIGS. 9 and 10, the playing cards 15 are placed in between the flexible fingers 40.

The foregoing description is included to illustrate the operation of the preferred embodiment and is not meant to limit the scope of the invention. The scope of the invention is to be limited only by the following claims.

What is claimed is:

1. A collapsible, game card holding means, said card holding means comprising:

a handle portion, of a generally linearly elongated configuration;

a pivoting means, said pivoting means connected to the top of said handle portion;

a plurality of flexible fingers, of a generally linearly elongated configuration, said flexible fingers pivotally connected to said handle portion via said pivoting means;

a limiting means, connected to the top of said handle portion, said limiting means positioned on both sides of said flexible fingers, with each flexible finger passing therethrough, said limiting means designed to come into mechanical interference with each flexible finger, thus creating frictional resistance that holds said flexible fingers in a desired position;

a card securement means, located at the end of each flexible finger, opposite said handle portion, said card securement means configured to hold a playing card; and a standing member, said standing member is attached to said handle portion via a hinge mechanism, wherein in the retracted position the standing member lies parallel with the handle member, and in the extended position, the standing member forms and angle with the handle member to support the card holding means in the vertical position.

2. The card holding means described in claim 1, wherein said flexible fingers protruding outward radially from the top of said handle portion and can be laterally separated and retracted in a fan-like configuration.

3. The card holding means described in claim 1, wherein the end portions of said flexible fingers, opposite said handle portion, are curved in the same plane as the plane formed by said extended flexible fingers, said curvature reducing the rotational ability of said playing cards once positioned in said card securement means.

4. The card holding means described in claim 1, wherein said card securement means consists of a card slot, extending into said flexible finger from the top end of said flexible finger a sufficient distance, so as to hold said playing card in place via frictional resistance, with said playing cards facing the user.

5. The card holding means described in claim 1, wherein said present invention comes in a variety of colors, and said handle portion can be configured in several ergonomic designs that provide a comfortable fit in the user's hand.

6. The card holding means described in claim 1, wherein said present invention comprises a handled device that allows the user to organize and hold a hand of playing cards and greatly reduces the amount of effort required to maintain the hand.

7. The card holding means described in claim 1, wherein said flexible fingers are of a flat, laterally extending configuration, with various configurations such as oval or rectangular, and said flexible fingers expand and retract in a fan-like configuration, with the frictional resistance between the main surface areas of said various flexible fingers facilitates insertion of and securement of playing cards therein, and as such acts as said card securement means.

8. The card holding means described in claim 7, wherein to use said present invention: first, the user extends said flexible fingers laterally; second, the user places cards in between said flexible fingers so as to facilitate play of a particular game; third, during game play, the user can switch playing cards around in said card securement means and organize them as playing cards are dealt, drawn, played and discarded; use of said present invention allowing the user to free-up his hands to do other things while playing; fourth, when game play is completed, said flexible fingers are retracted and said present invention is stored away for later use.

9. The card holding means described in claim 1, wherein to use said present invention: first, the user extends said flexible fingers laterally; second, the user places playing cards in said card securement means so as to facilitate play of a particular game; third, during game play, the user can switch playing cards around in said card securement means and organize them as playing cards are dealt, drawn, played and discarded; use of said present invention allowing the user to free-up his hands to do other things while playing; fourth, when game play is completed, said flexible fingers are retracted and said present invention is stored away for later use.

10. The card holding means described in claim 1, wherein said flexible fingers may be retracted with said playing cards in said card securement means 60, so as to enable the user to transport said playing cards in an easy manner.

11. The card holding means described in claim 1, wherein said card securement means further comprises:

a plurality of rectangular bars, one said rectangular bar attached to the end of each flexible finger, along the same elongated centerline as said flexible fingers, on the rear side of each flexible finger, each said bar flaring outward relative to each flexible finger, as the bar approaches the end of said flexible finger, opposite said handle portion, so as to form a friction fit between each flexible finger and each bar, as said playing card is slidably inserted along the elongated centerline of each flexible finger, between each said flexible finger and said bar.

12. The card holding means of claim 11, wherein each playing card is inserted vertically into each card securement means.

13. The card holding means of claim 1, wherein said standing member is of a generally triangular configuration, attached to said handle portion via a hinge mechanism.

14. The card holding means of claim 1, wherein a fan facie is attached to the front of each flexible finger so as to create a hand-held, fan-like appearance and configuration, as said flexible fingers are extended and retracted from each other during use of the present invention.

15. The card holding means of claim 14, wherein said fan facie is of a one-piece design, and is designed to provide a decorative barrier to viewing of each playing card, especially when players are sitting on either side of the user of the present invention.

16. The card holding means of claim 14, wherein decorative markings are placed on the front surface of said fan facie.

* * * * *